United States Patent [19]

Goldammer et al.

[11] 4,382,315

[45] May 10, 1983

[54] APPARATUS FOR OPENING BALES OF FIBER

[75] Inventors: Georg Goldammer, Gaimersheim; Günter Mahrt, Ingolstadt, both of Fed. Rep. of Germany

[73] Assignee: Schubert & Salzer, Maschinenfabrik Aktiengesellschaft, Ingolstadt, Fed. Rep. of Germany

[21] Appl. No.: 193,133

[22] Filed: Oct. 2, 1980

[30] Foreign Application Priority Data

Oct. 2, 1979 [DE] Fed. Rep. of Germany ..... 2939899

[51] Int. Cl.[3] ..... D01G 7/06

[52] U.S. Cl. ..... 19/81; 19/145.5

[58] Field of Search ..... 19/80 R, 81, 145.5

[56] References Cited

U.S. PATENT DOCUMENTS

| | | | |
|---|---|---|---|
| 3,443,285 | 5/1969 | Goldammer et al. | 19/81 |
| 3,577,599 | 5/1971 | Goldammer et al. | 19/145.5 |
| 4,107,820 | 8/1978 | Mahrt et al. | 19/81 |

FOREIGN PATENT DOCUMENTS

| | | | |
|---|---|---|---|
| 2060013 | 4/1981 | United Kingdom | 19/80 R |

*Primary Examiner*—Louis Rimrodt

*Attorney, Agent, or Firm*—Julian W. Dority

[57] ABSTRACT

An apparatus for opening bales of fibers using a gripper which detaches a layer of fibers from the top of a bale and then moves upwardly. A hold-back device is provided for grasping a web of fibers hanging down from said gripper device after the gripper device has been raised with the detached fiber material.

6 Claims, 4 Drawing Figures

APPARATUS FOR OPENING BALES OF FIBER

BACKGROUND OF THE INVENTION

The present invention relates to a method of opening bales of fiber, wherein a gripper detaches one layer of fibers at a time from the bale from above and then moves upwards, and an apparatus for carrying out the method.

It is known to detach fiber material from bales of fiber layer-by-layer by means of a gripping device with a gripper arm movable in the vertical direction (U.S. Pat. No. 3,443,285). The gripper arm has gripper fingers disposed in pairs which can be closed and opened like pincers, penetrate into a bale when the gripper arm is lowered onto this, and remove a layer of fiber during the upward movement of the gripper arm. Depending on the point of action of the gripper fingers on the bale and the pressing of the bale, there is the possibility that even with a small opening width of the gripper fingers, a layer of fibers reaching over the whole bale may be detached which then hangs down from the gripper arm as a web of fiber during the upward movement. This is undesirable, particularly when an amount corresponding to a specific mixing proportion has to be detached from bales of fiber of different origin by means of the gripping device (DE-OS 1.685.596). In this case, if such a large amount of fiber is detached shortly before the predetermined mixing proportion is reached, then the mixing proportion is exceeded and the mixing is inaccurate.

SUMMARY OF THE INVENTION

It is the object of the present invention to avoid this disadvantage and to provide a method and an apparatus which render possible a reduction in the amount of fiber detached in one detaching operation, in a simple manner.

According to the invention, this problem is solved in that a web of fiber hanging down freely from the gripper is held and that then a tensile force is exerted thereon until it tears off.

The apparatus for carrying out the method is characterized in that a hold-back device for a web of fiber hanging down is associated with the gripping device.

The construction designed to carry out the invention will be hereinafter described, together with other features thereof.

The invention will be more readily understood from a reading of the following specification and by reference to the accompanying drawing forming a part thereof, wherein an example of the invention is shown and wherein:

DESCRIPTION OF A PREFERRED EMBODIMENT

Figure 1:
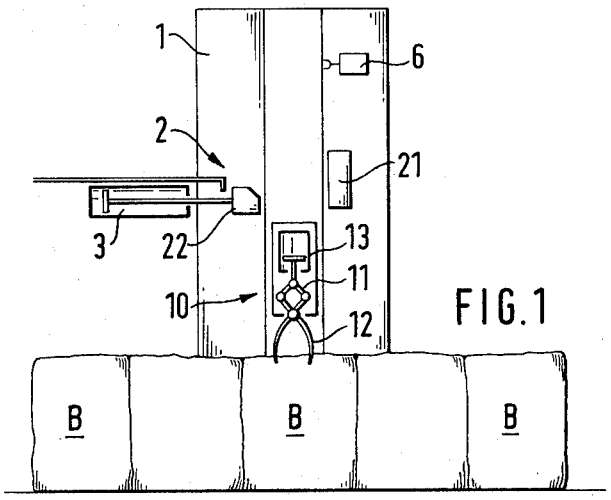
FIG. 1 is a side elevational view showing a gripping device with associated hold-back device during the removal of material from a bale of fiber.

According to FIG. 1, fiber material is detached from the bale B by means of a removal device 1 which contains a gripping device 10 with a gripper arm 11 movable in the vertical direction. The gripper arm carries gripper fingers 12 which are disposed in pairs and which can be opened and closed like pincers, for example pneumatically, using a compressed-air cylinder 13.

Figure 3:
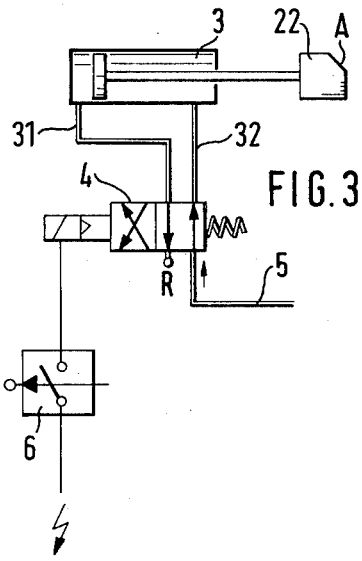
FIG. 3 shows the clamping jaw of the hold-back device of FIGS. 1 and 2 with pneumatic control.

Associated with the gripping device 10 is a hold-back device 2 for a web of fiber hanging down freely from the gripping device 10 after the removal of material, to render possible its tearing off from the gripping device, as will be explained later. The hold-back device 2 consists of a plate 21 secured to the frame of the removal device 1 and a clamping jaw 22 which can be urged against the plate 21 and is adapted so that the gripping fingers 12 must pass the opened hold-back device during their upward movement, before they reach their upper end position. The clamping jaw 22, movable transversely to the vertical direction of movement of the gripping device 10, is driven pneumatically for which purpose a compressed air cylinder 3 is provided (FIG. 3). A piston rod extends out of the cylinder and is secured to the clamping jaw 22. The supply of compressed air to the compressed air cylinder 3 is effected alternately through two conduits 31 and 32 and is controlled by a magnetically operated valve 4 which is connected through a conduit 5 to a source of compressed air (not shown).

Figure 2:
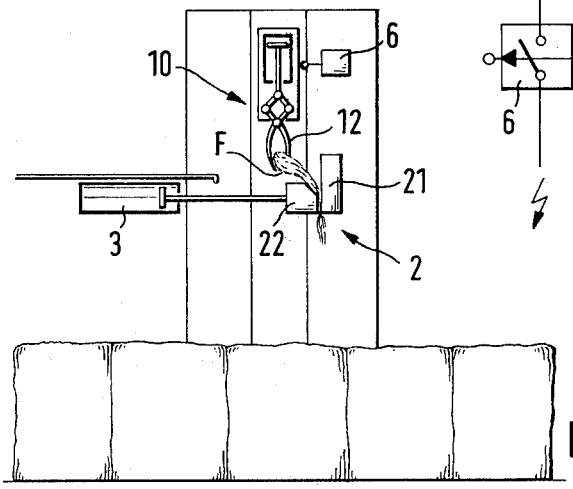
FIG. 2 shows the apparatus of FIG. 1 after the removal of material.

In the course of operation, the gripper fingers 12 grasp a layer of fibers from above in a bale B (FIG. 1), and move upwards. The clamping jaw 22 is in the retracted position so that the gripping device 10 can move without hindrance between it and the plate 21. After the gripper fingers 12 have passed the hold-back device 2 and before the gripping device 10 has reached its upper end position, the gripping device 10 actuates a switch 6 (FIG. 2) so that its contact, shown in the open position in FIG. 3, closes. As a result of the closing of the contact, the magnetically operated valve 4 is controlled so that compressed air flows through the conduit 31 into the compressed air cylinder 3. Thus the clamping jaw 22 moves towards the plate 21, in the course of which it strikes against a web of fiber F hanging down freely from the gripping device 10 and urges it against the plate 21 so that the web of fiber F is gripped. As a result of the further movement of the gripping device 10 into its upper end position, a tensile force is now exerted on the restrained web of fiber F, which causes the web of fiber F to tear off between the clamping point and the gripper fingers 12. As a result, the amount of fiber held by the gripper fingers 12 and then thrown away is reduced to such an extent as can be determined by the spacing between the clamping point of the hold-back device 2 and the gripper fingers 12 at the moment of gripping.

If the gripper arm 11 can be swung over a discharge point, the switch 6 may possibly only be actuated when the gripping device 10 has already reached the upper end position. The tearing off of the web of fiber F is then effected by the pivotal movement of the gripper arm 11.

During the subsequent downward movement of the gripping device 10 towards the bale B, the switch 6 is released so that its contact opens and the magnetically operated valve 4 switches over. Compressed air flows through the conduit 32 into the compressed air cylinder 3, while the compressed air in the rear portion of the cylinder escapes through the conduit 31. As a result, the clamping jaw 22 is moved away from the plate 21 into its position of release.

In order to be able to adjust the amount of fiber, remaining at the gripping device 10 until it is dropped, to various sizes, the hold-back device 2 is secured in slots on the frame of the removing device 1 and so is displaceable in the vertical direction. The switch 6 may likewise be adapted for displacement vertically. A construction of the hold-back device 2 differing from that described is possible. For example, instead of the clamping jaw 22 and the plate 21, rakes may be provided, the tines of which penetrate into the web of fiber F from both sides and hold it back in this manner.

Figure 4:
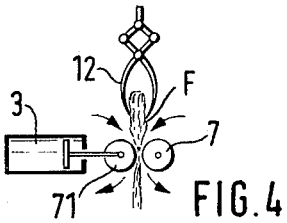
FIG. 4 shows another embodiment of the hold-back device.

The hold-back device shown in FIG. 4 is formed from a roller 7 secured to the frame of he removal device and a roller 71 which can be urged against the roller 7 by the piston rod of the compressed-air cylinder 3. Another drive device may, however, be provided for the roller 71, as also for the clamping jaw 22 of the device described above. Associated with at least one of the rollers, preferably the stationary roller 7, is a drive device (not shown) which sets the roller in rotation in a direction counter to the conveying direction of the web of fiber F hanging on the gripper fingers 12. As a result of the rotation of the rollers, a tensile force is exerted on the web of fiber F gripped between them, so that it tears.

While a preferred embodiment of the invention has been described using specific terms, such description is for illustrative purposes only, and it is to be understood that changes and variations may be made without departing from the spirit or scope of the following claims.

What is claimed is::

1. An apparatus for opening a bale of fibers with a gripper device which is moved from above said bale to detach fiber material from the top of said bale, and raising said detached fiber material with a web of fibers hanging down therefrom comprising:

a hold-back means (2) for grasping said web of fibers hanging down from said gripper device (10) after said gripper device has raised said detached fiber material from said bale.

2. The apparatus as set forth in claim 1 further comprising:

said hold-back means (2) including;

(i) a plate (21), and (ii) a clamping jaw (22) which can be urged against said plate (21).

3. The apparatus as set forth in claim 2 further comprising:

selectively operable pneumatic means urging said clamping jaw (22) against said plate (21).

4. An apparatus as set forth in claim 1 further comprising:

said hold-back means (2) including;

(i) a stationary roller (7), (ii) a driven roller (71), (iii) means for urging said rollers together for engaging said web of fibers hanging down from said gripper device (10), and (iv) means for driving said driven roller (71) in a direction of rotation counter to the conveying direction of said web of fibers as said fibers are lifted by said gripper device.

5. The apparatus as set forth in claim 4 further comprising:

said means for urging said rollers together including a selectively operable pneumatic means.

6. The apparatus as set forth in claim 1 further comprising:

means for vertically adjusting the position of said hold-back device above the top of said bale so that the amount of web fiber removed from the gripper device can be varied.

* * * * *